US006184762B1

(12) United States Patent
Reiss et al.

(10) Patent No.: US 6,184,762 B1
(45) Date of Patent: Feb. 6, 2001

(54) RELAY AND COMPONENT MODULE COMBINATION

(75) Inventors: Heiko Reiss; Jürgen Breitlow-Hertzfeldt, both of Berlin (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/214,852

(22) PCT Filed: Jun. 18, 1997

(86) PCT No.: PCT/DE97/01246

§ 371 Date: Jan. 11, 1999

§ 102(e) Date: Jan. 11, 1999

(87) PCT Pub. No.: WO98/01881

PCT Pub. Date: Jan. 15, 1998

(30) Foreign Application Priority Data

Jul. 10, 1996 (DE) ..... 296 12 042

(51) Int. Cl.[7] ..... H01H 9/02; H01H 13/04
(52) U.S. Cl. ..... 335/202; 335/132
(58) Field of Search ..... 335/132, 202; 200/295–305; 439/928, 213

(56) References Cited

U.S. PATENT DOCUMENTS 4,356,368 * 10/1982 Osika ..... 200/307
5,003,430 * 3/1991 VonArx et al. ..... 361/395
5,053,634 * 10/1991 Kakinuma ..... 335/202

FOREIGN PATENT DOCUMENTS 36 14919 A1 11/1987 (DE) .
296 12042 10/1996 (DE) .
0 189 924 8/1986 (EP) .
0 198 099 10/1986 (EP) .
0 409 613 A2 1/1991 (EP) .
0 507 729 A2 10/1992 (EP) .
2 696 040 3/1994 (FR) .
2 242 570 10/1991 (GB) .

* cited by examiner

*Primary Examiner*—Lincoln Donovan
(74) *Attorney, Agent, or Firm*—Hill & Simpson

(57) ABSTRACT

A relay and control module combination wherein the control module has an essentially cuboid housing with a coupling side for plug connection to an auxiliary connection side of a cuboid relay housing. Mutually complementary plug connector elements, which can be connected mechanically and electrically, are provided in both the coupling side and in the auxiliary connection side, The plug connector elements allow mechanical and electrical coupling between the control module and the relay. In this way, a universal relay can be converted into a special relay having a specific function by plugging on the control module.

7 Claims, 1 Drawing Sheet

RELAY AND COMPONENT MODULE COMBINATION

BACKGROUND OF THE INVENTION

1. Field of the Invention

The present invention relates to an arrangement of a relay and control module combination wherein the relay has an approximately cuboid housing with a main connection side from which load connecting elements emerge and with an auxiliary connection side with control connections. The the control module has a module housing with a coupling side which can be fitted to the auxiliary connection side of the relay housing and, in the region of the coupling side to the control connections, has complementary plug connections which produce an electrical connection of the control module for the relay.

2. Description of the Prior Art

Electrical and electronic circuits which are arranged separately from the relay, for example on a printed circuit board, are widely used for actuating and monitoring electromagnetic relays. It is often desirable to combine the relay with its actuation circuit, in which case it is also known for an electronic circuit to be accommodated in the relay housing itself. However, such a relay with a built-in electronic circuit is more complex and more expensive and, owing to the special circuitry, can be used only for specific purposes. In addition, the required quantities for such designs are typically relatively low. It is also known for an electronic module to be produced for a relay as a separate module and, if required, to be accommodated in an appropriate chamber in the relay housing (DE 36 14 919 A1). The electrical coupling between the electronic module and the relay is, in this case, produced externally via a printed circuit board or the like.

Furthermore, it is also known for a plug-in relay and an additional module to be connected via their respective housings to form a unit (EP 05 07 729 A2). In this case, however, the electrical coupling of the additional module to the relay is once again produced only via the respective connecting pins and via a common relay socket. In contrast, the housings are connected to one another mechanically. On the other hand, relays have also been disclosed (EP 0409 613 A2) which have connecting pins on various housing sides in order, for example, to carry out the actuation via a solder side of a printed circuit board while the load connections are coupled via blade plugs.

FR-A1-26 96 040 discloses an interrupter switch whose design corresponds to the relay construction mentioned initially. There, however, the load connecting elements are not connected to a main connection side until additional modules have been fitted. As a result, the multi-part housing has openings on all sides which is unacceptable for a relay subject to relatively stringent requirements for insulation and electric-shock protection. A control module in the form of a heat protection relay is likewise schematically indicated, without any matching of the respective housing shapes being evident.

The aim of the present invention is to provide an arrangement of a relay with a control module of the type mentioned at the beginning, wherein the module can be coupled, as required, to the relay. In addition, the module forms not only a mechanical unit with the relay, but also an electrical unit; the relay also capable of being operated normally without the control module.

SUMMARY OF THE INVENTION

According to the present invention, this aim is achieved in that the module housing is cuboid in shape, wherein the module housing and the auxiliary connection side of the relay housing on the coupling side of the module housing have identical areas and are matched to one another in such a manner that, once the two housings have been plugged onto one another, they form an approximately cuboid combination housing.

On its housing, the control module of the present invention has a coupling side with plug elements by means of which it can be plugged onto a corresponding relay housing which has an auxiliary connection side with corresponding control plug connections. Since the relay itself invariably has a main connection side via which coil connections can be connected, the control module could be operated on its own with the plug connections of its coupling side toward the relay. However, in addition to its coupling side, the control module preferably also has a further module connection side with external connections. In this case, particularly good electrical isolation of all the control and test connections from the load connections of the relay is possible.

The control module according to the present invention, which can be plugged on, allows the use of a relay designed for universal purposes both with and without this control module. As such, it is feasible for the relay to contain only additional connecting elements in a cap, with all the functional elements having a completely identical design. In this case, it is possible to produce either a normal relay without additional control or a relay which can be combined with the control module; for example, by replacing the cap. Plugging the control module on connects the two housings not only electrically but also mechanically. In order to reinforce this mechanical connection, latching elements which engage one another can be provided on both housings. Furthermore, the housing gap between the relay housing on the one side and the module housing on the other side can be sealed.

Additional features and advantages of the present invention are described in, and will be apparent from, the Detailed Description of the Preferred Embodiments and the Drawings.

DETAILED DESCRIPTION OF THE PREFERRED EMBODIMENTS

Figure 1:
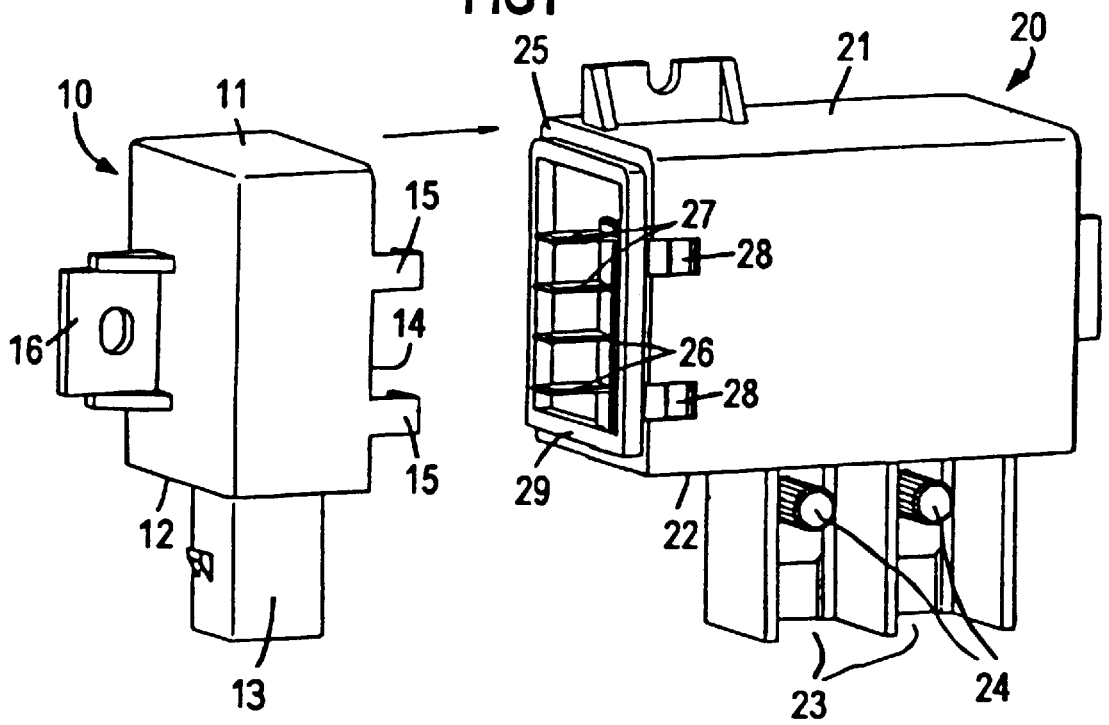
FIG. 1 shows a control module of the present invention with a matching relay while they are being plugged onto one another.

FIG. 1 shows a control module 10 with a module housing 11, which can be joined together with a relay 20 and its relay housing 21 to form a relay module 30 with a combination housing 31. The control module 10 has an essentially cuboid housing 11 which, additionally, has an integrally formed plug collar 13 on its underneath or module connection side 12. This plug collar 13 encloses connecting elements which cannot be seen; for example, blade plugs or round plugs. Furthermore, the housing 11 forms a coupling side 14 in which plug openings (which cannot be seen) with plug sockets are provided. These are provided for mechanical and electrical connection to the blade plugs of the relay 20, which are still to be described. Furthermore, a latching hook 15 is, in each case, integrally formed to the side of the coupling side 14. A fastening lug 16, for example, is integrally formed on the opposite side.

The relay housing 21 is likewise substantially cuboid in shape. On its underneath or main connection side 22, it has two chambers 23 in which load connecting elements 24 for high currents, for example 150 A, and which pass out of the relay interior are arranged. The leads can be connected, for example, via screw terminals. In order to achieve complete isolation between the load connections and the control connections, the latter are not passed to the outside on the main connection side but on an auxiliary connection side 25 of the housing 21, which is at right angles to the main connection side. In the present example, there are two coil connections 26 and two additional load connections 27 via which, however, only relatively low currents, for example of a maximum 5 A, can be carried. These additional load connections 27 are used, for example, to measure the load current in the additional control module 10. Latching recesses 28 corresponding to the latching hooks 15 on the control module 10 are formed to the side of the auxiliary connection side 25. Furthermore, a circumferential sealing collar 29 is arranged on the auxiliary connection side 25 and is, for example, molded from an elastomer material.

The internal construction of the relay 20 is irrelevant here. It may, in this case, be a conventional electromagnetic system, in which case the load connections 24 and 27 as well as the coil connections 26 are passed out in the illustrated manner by an appropriate physical design. The connections 26 and 27 are expediently mounted in the cap itself, wherein, in a preferred embodiment, their coupling to the coil connections on the one side of the relay and the load connections on the other side of the relay can be produced by plugging on the cap.

The control module 10 likewise may have any required internal design. Depending on the application, this control module 10 contains an electronic control circuit for actuating the electromagnet system in accordance with specific conditions, for example as a time controller, as a battery isolating circuit on the basis of specific requirements, as a load-current monitor or in order to reduce the coil power when the relay is held on. The control module 10 may also contain a diagnostic capability.

Figure 2:
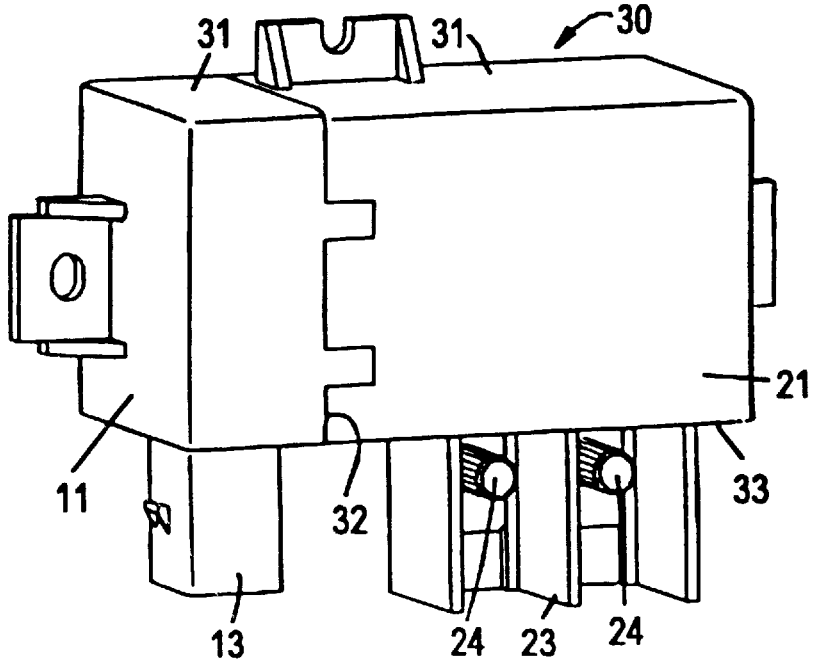
FIG. 2 shows a relay module which is formed from the relay and the control module of FIG. 1.

When the module housing 11 is plugged onto the relay housing 21, a combination housing 31 is produced as shown in FIG. 2; this itself being essentially cuboid in shape. The coupling joint 32 between the two individual housings is closed so that it is washproof by the sealing collar 29, so that the plug connections 26 and 27, together with the plug sockets (which are not illustrated) in the module housing 11, are protected. An appropriate arrangement of the main connection side 33 and of the auxiliary connection side 25 on the relay housing 21 on the one hand, as well as the module connection side 12 and the coupling side 14 of the module housing 11 on the other hand, results in a common connection side 33 from which both the load connections 24 as well as the module connections (which cannot be seen) in the plug collar 13 emerge.

Although the present invention has been described with reference to specific embodiments, those of skill in the art will recognize that changes may be made thereto without departing from the spirit and scope of the invention as set forth in the hereafter appended claims.

What is claimed is:

1. A relay control module combination, comprising:

a relay, the relay including a cuboid relay housing having both a main connection side and an auxiliary connection side, the relay having a plurality of load connecting elements extending from the main connection side and further having a plurality of control connections extending from the auxiliary connection side, the relay being operable for universal purposes both with and without an attachable control module; and a control module, the control module including a cuboid module housing having a coupling side which may be cooperatively engaged with the auxiliary connection side of the relay housing, the control module having a plurality of complementary plug connections extending from the coupling side for electrical connection to the plurality of control connections on the relay housing when the module housing is cooperatively engaged with the relay housing, the coupling side of the module housing further having circumferential dimensions which match circumferential dimensions of the auxiliary connection side of the relay housing wherein the module housing and the relay housing collectively form a cuboid combination housing when the module housing is cooperatively engaged with the relay housing.

2. The relay and control module combination as claimed in claim 1, further comprising engageable latching elements on both the module housing and the relay housing.

3. The relay and control module combination as claimed in claim 2, wherein the engageable latching elements are recessively formed in surfaces of both the module housing and the relay housing.

4. A relay and control module combination as claimed in claim 1, further comprising:

a circumferential elastic seal disposed between edges of the coupling side of the module housing and the auxiliary connection side of the relay housing.

5. A relay and control module combination as claimed in claim 1, wherein the module housing further has a module connection side from which additional external connections extend.

6. A relay and control module combination as claimed in claim 5, wherein a plug collar which encloses the additional external connections is integrally formed in the module housing on the module connection side.

7. A relay and control module combination as claimed in claim 6, wherein the auxiliary connection side and the main connection side of the relay housing are at right angles to one another, and wherein the coupling side and the module connection side of the module housing are at right angles to one another.

* * * * *